US008506346B2

(12) United States Patent
Nakayama et al.

(10) Patent No.: US 8,506,346 B2
(45) Date of Patent: Aug. 13, 2013

(54) AUTOMOBILE TOY

(75) Inventors: Kenji Nakayama, Tokyo (JP); Tomohito Nagai, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 158 days.

(21) Appl. No.: 12/943,258

(22) Filed: Nov. 10, 2010

(65) Prior Publication Data

US 2011/0177754 A1 Jul. 21, 2011

(30) Foreign Application Priority Data

Jan. 15, 2010 (JP) ..... 2010-006628

(51) Int. Cl.
*A63H 17/00* (2006.01)

(52) U.S. Cl.
USPC ..... 446/465

(58) Field of Classification Search
USPC ..... 446/431, 465–471
See application file for complete search history.

(56) References Cited

U.S. PATENT DOCUMENTS

| | | | | |
|---|---|---|---|---|
| 2,649,806 | A * | 8/1953 | Monaghan | 446/381 |
| 3,009,287 | A * | 11/1961 | Davis | 446/466 |
| 3,063,194 | A * | 11/1962 | Berguerand | 446/466 |
| 3,083,499 | A * | 4/1963 | Balthazor | 446/466 |
| 3,121,294 | A * | 2/1964 | Balthazor | 446/466 |
| 3,273,924 | A | 9/1966 | Mexeiner | |
| 3,628,284 | A | 12/1971 | Soulakis et al. | |
| 3,720,017 | A * | 3/1973 | Ersillio | 446/466 |
| 4,159,126 | A * | 6/1979 | Raleigh | 446/466 |
| 4,466,215 | A * | 8/1984 | Hanazato | 446/469 |
| 4,717,367 | A | 1/1988 | Stubenfoll et al. | |
| 4,764,150 | A | 8/1988 | Uchino | |
| 4,894,044 | A | 1/1990 | Poulin et al. | |
| 5,000,716 | A | 3/1991 | Canavesi | |
| 5,071,525 | A | 12/1991 | Ushiyama | |
| 5,338,247 | A * | 8/1994 | Miles | 446/456 |
| 5,549,700 | A | 8/1996 | Graham et al. | |
| 5,609,510 | A | 3/1997 | Stubenfoll et al. | |
| 6,350,173 | B1 * | 2/2002 | Tsang | 446/444 |
| 6,540,583 | B1 | 4/2003 | Hoeting et al. | |
| 7,435,181 | B2 | 10/2008 | Cummins et al. | |
| 2003/0077979 | A1 | 4/2003 | Hoeting et al. | |
| 2004/0227049 | A1 | 11/2004 | Lang et al. | |
| 2005/0208869 | A1 | 9/2005 | Reuter | |

(Continued)

FOREIGN PATENT DOCUMENTS

| | | |
|---|---|---|
| CN | 2633384 | 8/2004 |
| CN | 2635167 | 8/2004 |

(Continued)

OTHER PUBLICATIONS

Japanese Office Action dated Aug. 2, 2011 in Application No. 2010-006628.

(Continued)

*Primary Examiner* — Gene Kim
*Assistant Examiner* — Alyssa Hylinski

(57) ABSTRACT

An automobile toy, including, a front wheel chassis for supporting a front wheel axle, and a rear wheel chassis for supporting a rear wheel axle, the rear wheel chassis including, two arms extending forward, an end portion of each of the two arms being coupled to the front wheel chassis with the two arms separated from each other in a vehicle width direction of the automobile toy.

5 Claims, 8 Drawing Sheets

(56) References Cited

U.S. PATENT DOCUMENTS

| | | | |
|---|---|---|---|
| 2006/0057934 | A1 | 3/2006 | Sato |
| 2008/0171486 | A1 | 7/2008 | Nagaoka |
| 2008/0318491 | A1 | 12/2008 | Ishibashi et al. |
| 2009/0062923 | A1 | 3/2009 | Swanson |

FOREIGN PATENT DOCUMENTS

| | | | | |
|---|---|---|---|---|
| CN | 200991587 | | | 12/2007 |
| DE | 7018284 | | | 11/1970 |
| DE | 102004011932 | | | 9/2005 |
| EP | 1852165 | | | 11/2007 |
| EP | 2044990 | | | 4/2009 |
| GB | 1072412 | A | * | 6/1967 |
| JP | 43-25303 | | | 10/1968 |
| JP | 56-31270 | | | 7/1981 |
| JP | 2-43440 | | | 11/1990 |
| JP | 4-26150 | | | 6/1992 |
| JP | 7-313738 | | | 12/1995 |
| JP | 09-108452 | | | 4/1997 |
| JP | 3798350 | | | 4/2006 |
| JP | 2009-442 | | | 1/2009 |

OTHER PUBLICATIONS

U.S. Office Action dated Mar. 29, 2012 in co-pending U.S. Appl. No. 12/943,295.

European Abstract, Publication No. 7018284, Published Nov. 19, 1970.

European Abstract, Publication No. 102004011932, Published Sep. 29, 2005.

European Abstract, Publication No. 2633384, Published Auguat 18, 2004.

European Abstract, Publication No. 2635167, Published Aug. 25, 2004.

European Abstract, Publication No. 200991587, Published Dec. 19, 2007.

European Communication dated May 16, 2001 in Application No. 10189549.8.

European Communication dated May 13, 2001 in Application No. 10189575.3.

Patent Abstracts of Japan, Publication No. 09-108452, Published Apr. 28, 1997.

U.S. Appl. No. 12/943,295, filed Nov. 10, 2010, Kenji Nakayama et al.

U.S. Appl. No. 12/943,254, filed Nov. 10, 2010, Kenji Nakayama et al.

Office Action (Notification of Reasons for Refusal), mailed Nov. 8, 2011 and issued in corresponding Japanese Patent Application No. 2010-006639.

MINI-Z de asobou! (Let's play with MINI-Z!), Published by YAESU Publishing Company, Jan. 14, 2008, pp. 7, 11 and 58, Cover page, Back page, (5 pages).

Final Office Action mailed Aug. 17, 2012 in U.S. Appl. No. 12/943,295.

* cited by examiner

VIEWED FROM ARROWS A

VIEWED FROM ARROWS B

AUTOMOBILE TOY

BACKGROUND OF THE INVENTION

1. Field of the Invention

The present invention relates to an automobile toy.

2. Description of Related Art

A conventional automobile toy capable of traveling has a chassis that supports an axle and is divided into a front part and a rear part. The automobile toy simply realizes a road surface following function of a wheel and a suspension function by means of a coupling structure coupling these front and rear chassis so that these front and rear chassis are relatively rockable with each other in a vertical direction (see, for example, Japanese Patent Publication No. 3798350).

The coupling structure is generally the structure of coupling a front wheel chassis for supporting a front wheel axle and a rear wheel chassis for supporting a rear wheel axle with a coupling member, shaped in an almost T shape in a planar view, at the center of the automobile toy in the vehicle width direction thereof. The coupling member is fixed to the rear wheel chassis with a rod-like projecting portion (lower end of T) directed to the front wheel chassis, and the apical end of the projecting portion is coupled to the front wheel chassis to be rockable with a ball joint structure.

In such a coupling structure, however, the space for arranging an electric circuit board and the like on the front wheel chassis is very limited, because the coupling member is coupled at the center of the front wheel chassis in the vehicle width direction. As a result, the electric circuit board and the like must be arranged to avoid the coupling member. Consequently, the structure of the automobile toy becomes complicated, and it is difficult to achieve the miniaturization and the weight saving thereof.

SUMMARY OF THE INVENTION

It is, therefore, an object of the present invention to couple a front and a rear chassis, achieving the miniaturization and weight saving of an automobile toy.

According to an aspect of the present invention, there is provided an automobile toy, including, a front wheel chassis for supporting a front wheel axle, and a rear wheel chassis for supporting a rear wheel axle, the rear wheel chassis including, two arms extending forward, an end portion of each of the two arms being coupled to the front wheel chassis with the two arms separated from each other in a vehicle width direction of the automobile toy.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE EMBODIMENTS

In the following, embodiments of the present invention will be described with reference to the accompanying drawings.

Figure 1:
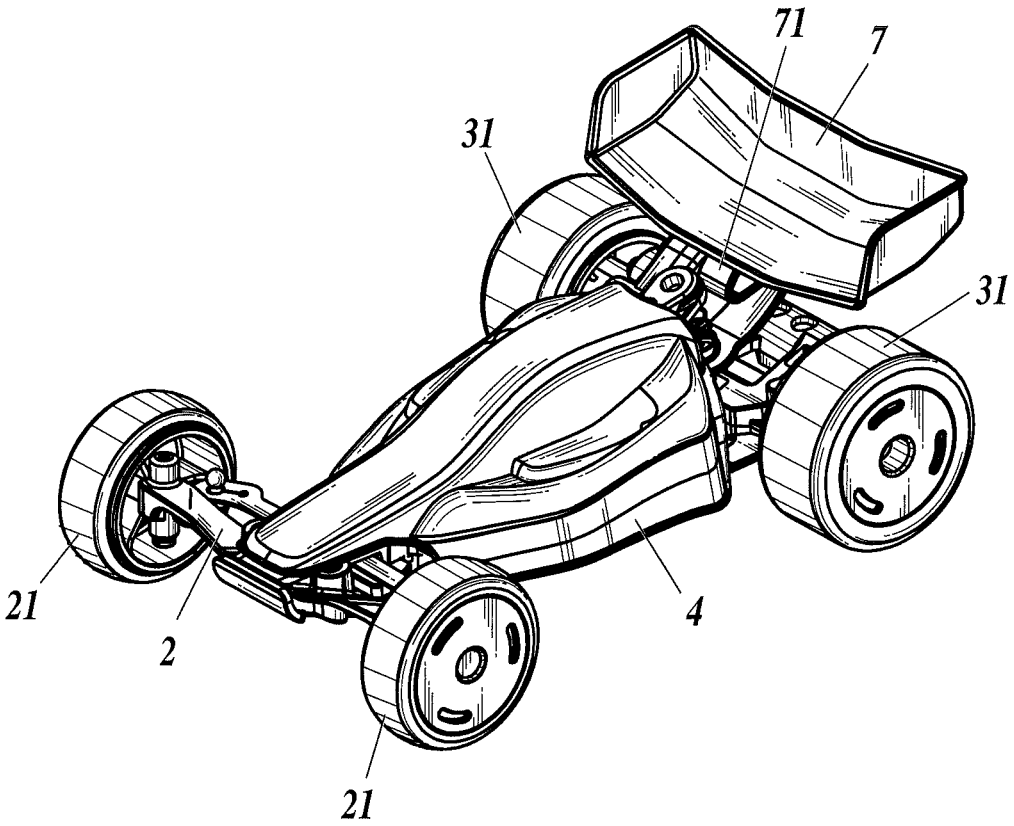
FIG. 1 is a perspective view of an automobile toy of an embodiment of the present invention.

FIG. 1 is a perspective view of an automobile toy 1 of the present embodiment.

As shown in this figure, the automobile toy 1 is a travelling toy imitating an off-road vehicle and is equipped with a front wheel axle 2 for supporting front wheels 21, 21 to be able to be steered right and left; a rear wheel axle 3 (see FIG. 5) for supporting rear wheels 31, 31; a body 4, and a wing member 7.

Figure 2:
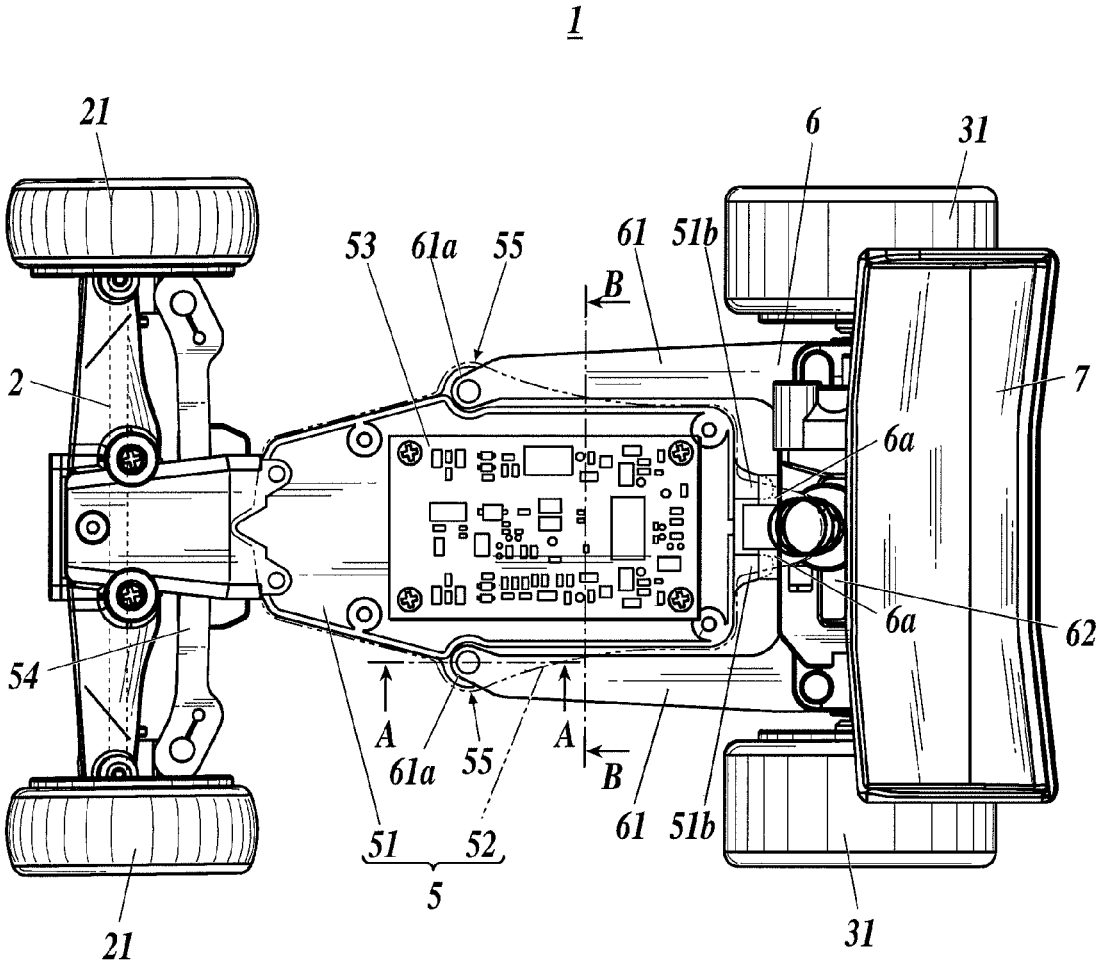
FIG. 2 is a top plan view of the automobile toy from which a body is removed.

FIG. 2 is a plan view of the automobile toy 1 from which the body 4 is removed.

As shown in this figure, the front wheel axle 2 is supported by a front wheel chassis 5, and the rear wheel axle 3 is supported by a rear wheel chassis 6.

The front wheel chassis 5 is composed of a lower front wheel chassis 51, which is shaped in an almost flat plate and supports the front wheel axle 2 at a front end portion of the front wheel chassis 5, and an upper front wheel chassis 52 (shown by chain double-dashed lines in FIG. 2), covering a central portion of the automobile body of the lower front wheel chassis 51. The lower front wheel chassis 51 and the upper front wheel chassis 52 engage with each other. An electric circuit board 53 which receives a control signal from a remote controller 8, described later, to drive each portion, is placed on the lower front wheel chassis 51, and the electric circuit board 53 is covered by the upper front wheel chassis 52. Furthermore, a steering motor and a gear mechanism, which are not shown, are mounted on the lower front wheel chassis 51, and a steering rack 54, coupled to the front wheels 21, 21, is supported in parallel with the front wheel axle 2 so as to be movable in a right and left direction. These parts constitute a steering mechanism of the automobile toy 1. The steering motor drives the steering rack 54 right and left through the gear mechanism, and thereby the front wheels 21, 21 change their directions right and left. The automobile toy 1 is thus steered. Furthermore, a battery, not shown, is mounted on the lower front wheel chassis 51.

On the other hand, a drive motor 62, having a motor shaft coupled to the rear wheel axle 3, is mounted in the rear end portion of the rear wheel chassis 6. The rear wheel chassis 6 includes two arms 61, 61, extending forward along both-side portions of the automobile toy 1, and the rear wheel chassis 6 is formed in an almost U-shape in a planar view.

These front wheel chassis 5 and rear wheel chassis 6 are coupled to each other by the two arms 61, 61 in the both-side portions of each of the chassis 5 and 6. Respective end portions 61*a* of the two arms 61, 61 are coupled to coupling portions 55, provided as projections in the both-side portions of the front wheel chassis 5, with the two arms 61, 61 separated from each other in the vehicle width direction, with the rear end portion of the front wheel chassis 5 put between the arms 61, 61.

Figure 3:
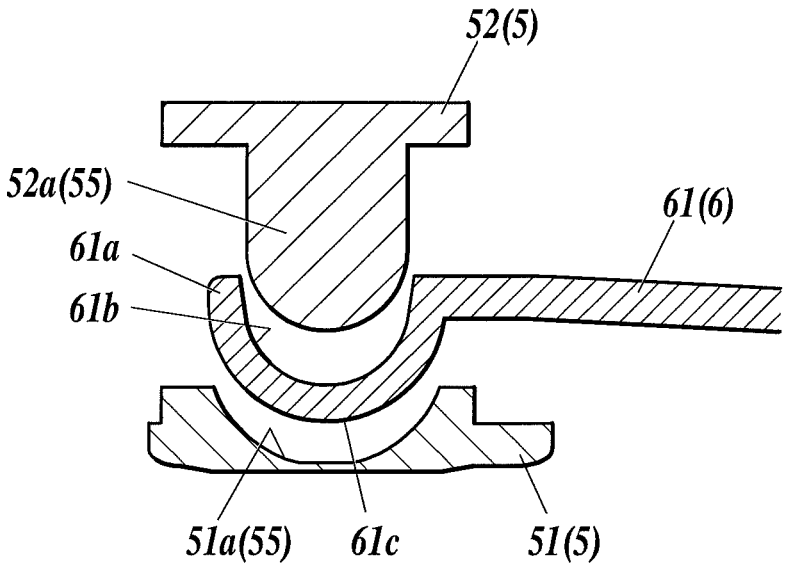
FIG. 3 is a sectional view along arrows A in FIG. 2.
Figure 4:
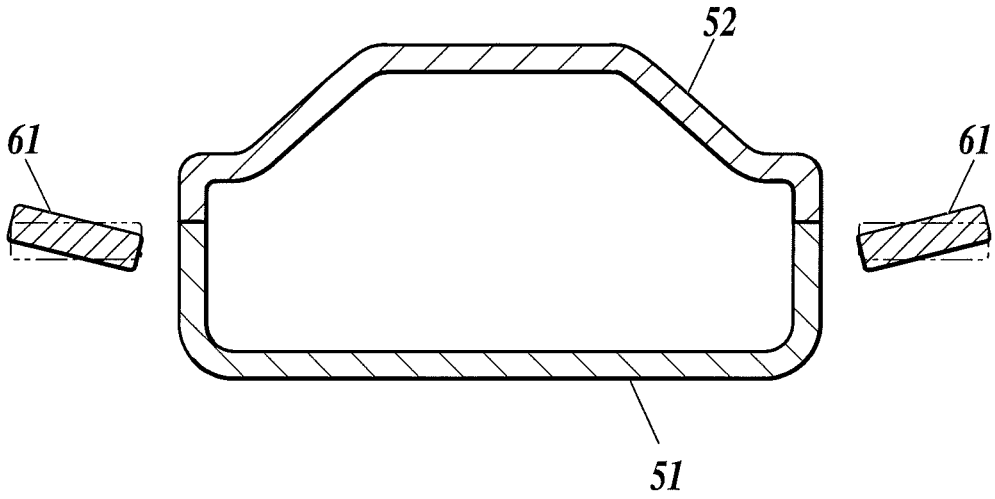
FIG. 4 is a sectional view along arrows B in FIG. 2.

FIG. 3 is a sectional view along arrows A in FIG. 2, and FIG. 4 is a sectional view along arrows B in FIG. 2. In addition, FIG. 3 shows wide gaps between each part in order to make the figure easy to understand.

As shown in FIG. 3, a hemispherical first projecting portion 52*a*, projecting downward and formed on the upper front wheel chassis 52, and a hemispherical second concave portion 51*a*, opening upward and formed on the lower front wheel chassis 51, are formed at each of the coupling portions 55. Furthermore, a hemispherical first concave portion 61*b*, opening upward complementarily to the first projecting portion 52*a*, and a hemispherical second projecting portion 61*c*, projecting downward complementarily to the second concave portion 51*a*, are formed at each of the end portions 61*a* of the arms 61, 61, with the first concave portion 61*b* and the second projecting portion 61*c* mutually concentric. Each of the end portions 61*a* of the arms 61, 61 is nipped by the upper front wheel chassis 52 and the lower front wheel chassis 51 from above and below in such a way that the first projecting portion 52*a* and the first concave portion 61*b* are slidably fitted to each other, and that the second projecting portion 61*c* and the second concave portion 51*a* are slidably fitted to each other. In addition, the surfaces of the first concave portion 61*b* and the second projecting portion 61*c* correspond to a first sliding surface, and the surfaces of the first projecting portion 52*a* and the second concave portion 51*a* correspond to a second sliding surface.

By providing such a coupling structure on the both-side portions, relative rocking between the front wheel chassis 5 and the rear wheel chassis 6 in the horizontal direction and the vertical direction can be allowed, and a road surface following function of the front and rear wheels 21 and 31 and a suspension function of the automobile toy 1 are realized.

Furthermore, each of the two arms 61, 61 is formed in a flat plate inclining toward the inside of the automobile toy 1 in the vehicle width direction in the neighborhood of each of the end portions 61*a* as shown in FIG. 4. To put it more minutely, each of the arms 61, 61 is formed to be horizontal at its base end portion, shown by chain double-dashed lines in the figure, and to incline more to the inside as its position becomes closer to the end portion 61*a* thereof. By inclining the arms 61, 61 in this way, even if an external force parallel to the vehicle width direction of the automobile toy 1 is applied to each of the arms 61, 61, the arm 61 can disperse the external force according to the inclination angle thereof, and the load which operates on the arm 61 into the vehicle width direction can be reduced.

Furthermore, each of the two arms 61, 61 is made of a twistable elastic member. Consequently, by the twisting of the arm 61, a twist angle between the front wheel chassis 5 and the rear wheel chassis 6 can be enlarged. In addition, because each of the arms 61, 61 can elastically be deformed into the vertical direction, the suspension function of the automobile toy 1 can be strengthened.

Figure 5:
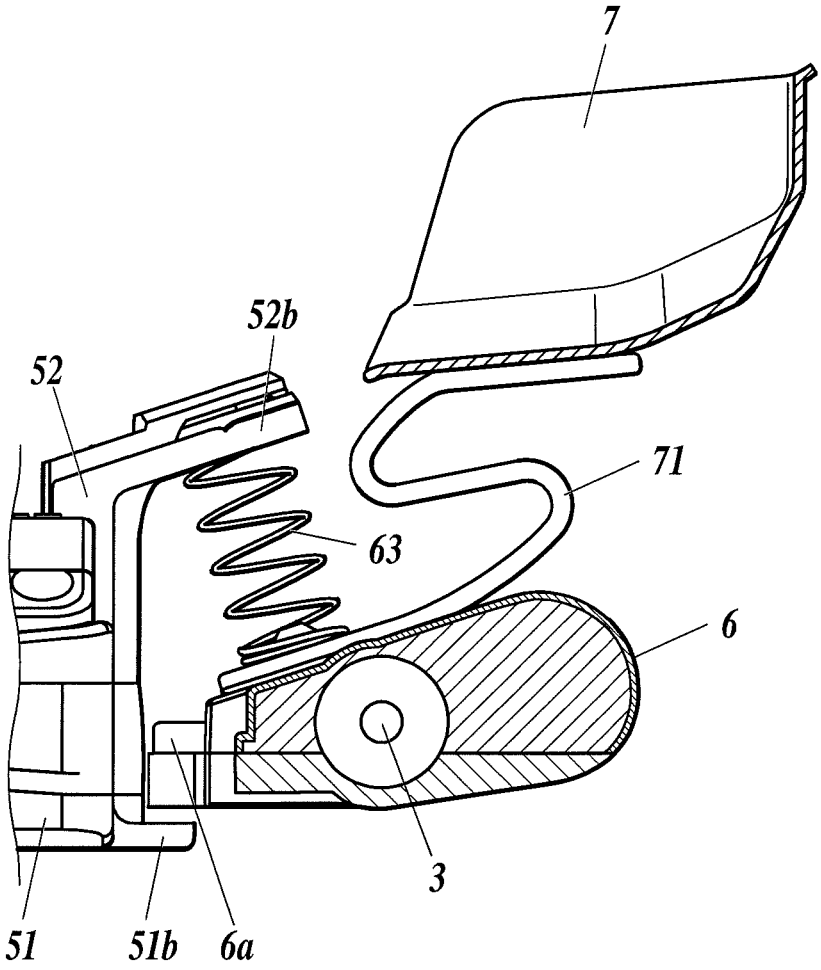
FIG. 5 is a partial sectional view of a rear end portion of the automobile toy.

FIG. 5 is a partial sectional view of the rear end portion of the automobile toy 1.

As shown in this figure, the wing member 7 is coupled to the rear wheel chassis 6 through the intermediary of a stay member 71, made of an elastic member. The stay member 71 has a portion bent in an "S" shape in the front and rear direction, and only one stay member 71 is attached to the central part of the wing member 7 in the vehicle width direction (see FIG. 1). By attaching the wing member 7 through the intermediary of such a stay member 71, a local stress concentration on the stay member 71 is moderated, and plastic deformation and breakage of the stay member 71 can be prevented, even if the wing member 7 touches a wall or a road surface owing to an overturn or the like of the automobile toy 1.

One end of a spring member 63 is fixed to the front end portion of the stay member 71, and the other end of the spring member 63 is fixed to a projecting portion 52*b* at the rear end of the upper front wheel chassis 52. The spring member 63 biases the front wheel chassis 5 and the rear wheel chassis 6 into almost the vertical direction and mainly fulfills the function of a suspension.

Furthermore, locking portions 51*b*, 51*b*, projecting rearward, are formed in the rear end portion of the lower front wheel chassis 51, and projections 6*a*, 6*a*, projecting forward, are formed over the locking portions 51*b*, 51*b* at the front end portion of the rear wheel chassis 6 (see FIG. 2). These locking portions 51*b*, 51*b* and projections 6*a*, 6*a* are provided for regulating the relative rocking of the front wheel chassis 5 and the rear wheel chassis 6 in the vertical direction around the end portions 61*a* of the arms 61, 61. By regulating the relative rocking of the front wheel chassis 5 and the rear wheel chassis 6 within a predetermined range in such a way, the end portions 61*a* of the arms 61, 61 are prevented from being dropped off from the coupling portions 55, and a wiring between the electric circuit board 53 and the drive motor 62 is prevented from being exposed. In addition, the biasing force of the spring member 63 is adjusted so that the locking portions 51*b*, 51*b* and the projections 6*a*, 6*a* are stabilized in the state of being separated by a predetermined distance in the vertical direction in their normal states.

Figure 6:
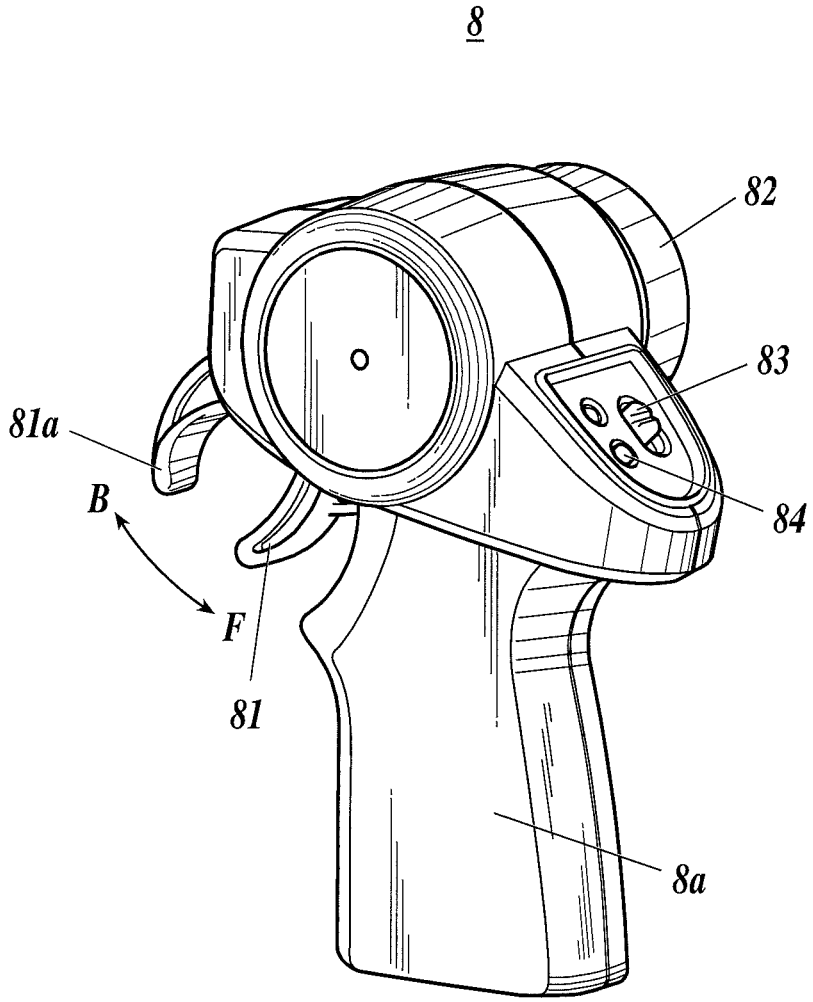
FIG. 6 is a perspective view of a remote controller.

FIG. 6 is a perspective view of the remote controller 8 for remotely operating the automobile toy 1.

As shown in this figure, the remote controller 8 is equipped with a lever portion 81 for driving the drive motor 62 to advance or reverse the automobile toy 1, and a steering wheel portion 82 for driving the steering motor to steer the automobile toy 1. The present embodiment is configured so that a user operates the lever portion 81 with the left hand grasping a grip portion 8*a*, and operates the steering wheel portion 82 with the right hand.

When the lever portion 81 is moved from its neutral state into the F direction in the figure, the automobile toy 1 is advanced. When the lever portion 81 is moved from its neutral state into the B direction in the figure, the automobile toy 1 is reversed after being braked for a predetermined time. Furthermore, a projecting portion 81*a* is formed in the B-direction part of the lever portion 81 which projects into the direction (front side of FIG. 6) opposite to the steering wheel portion 82. Thereby, the remote controller 8 is configured so that an operating finger (for example, the forefinger of the left hand) does not easily slip out at the time of operating the lever portion 81 into the B direction.

The steering wheel portion 82 is configured to be able to drive the steering motor to steer the automobile toy 1 to the left and the right sides by being rotated from its neutral state to the left or the right directions.

Furthermore, the remote controller 8 is equipped with a frequency setting button 84 for switching the operable automobile toy 1, besides an electric power switch 83. By depressing the frequency setting button 84 while a setting signal is output from the automobile toy 1, a setting can be made where the operation of the automobile toy 1, outputting the setting signal, is allowed.

Figure 7:
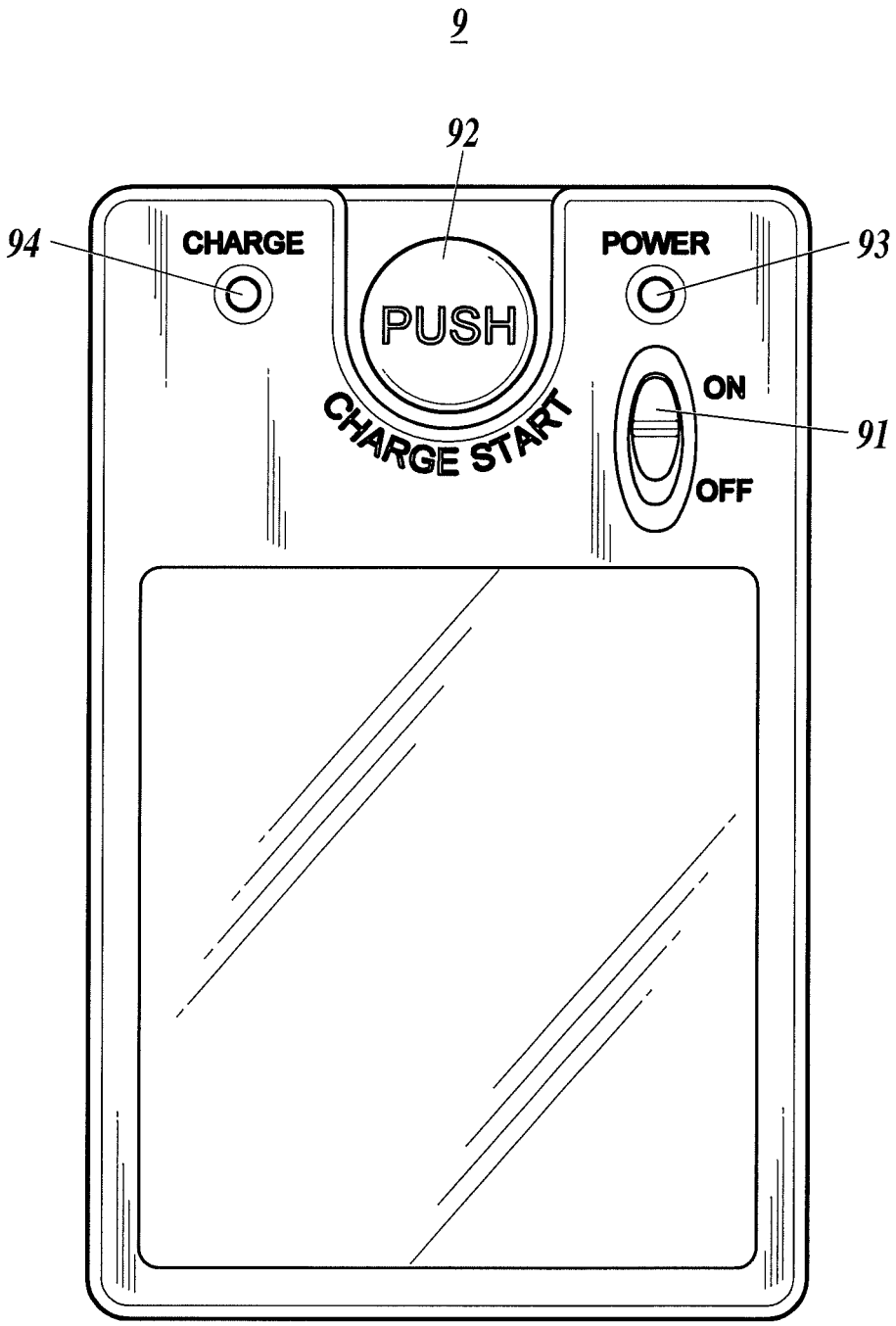
FIG. 7 is a front view of a charger.

FIG. 7 is a front view of a charger 9 for charging the battery of the automobile toy 1.

As shown in this figure, the charger 9 is equipped with an electric power switch 91 and a charge starting button 92, and is configured to be able to charge the battery of the automobile toy 1 by supplying electric power from a built-in battery, not shown, to the battery of the automobile toy 1, by turning on the electric power switch 91 and depressing the charge starting button 92 in the sate of connecting a charging cable, not shown, to the automobile toy 1. Furthermore, the charger 9 is equipped with a power source light emitting diode (LED) 93 and a charging LED 94. Whether the power source is on or off can be judged by whether the light of the power source LED 93 is on or off, respectively. Further, whether the charging state of the charger 9 is "during charging" or "completion" can be judged by whether the light of the charging LED 94 is on or off, respectively.

According to the automobile toy 1 described above, the rear wheel chassis 6 includes the two arms 61, 61 extending forward along the both-side portions, and the two arms 61, 61 are coupled to the front wheel chassis 5 at the respective end portions 61*a* with the two arms separated from each other in the vehicle width direction. Consequently, the front wheel chassis 5 and the rear wheel chassis 6 can be coupled to each other without oppressing the space on the front wheel chassis 5. The electric circuit board 53 and the like can, hereby, be arranged easily without the necessity of avoiding any coupling members in comparison with the conventional art, using a T-shaped coupling member. That is, the structure can be simplified to achieve the miniaturization and the weight saving of the automobile toy 1. Consequently, the front and the rear wheel chassis 5 and 6 can be coupled to each other with the miniaturization and the weight saving thereof achieved.

Furthermore, because the respective end portions 61*a* of the two arms 61, 61 are nipped from above and below by the upper front wheel chassis 52 and the lower front wheel chassis 51, the end portions 61*a* of the arms 61, 61 are prevented from being dropped off from the front wheel chassis 5, and the twist angle between the front wheel chassis 5 and the rear wheel chassis 6 can be enlarged.

Furthermore, the end portions 61*a* of the two arms 61, 61 are coupled to the both-side portions of the front wheel chassis 5, with the first concave portions 61*b* fitted to the first projecting portions 52*a* of the upper front wheel chassis 52 slidably and with the second projecting portions 61*c* fitted to the second concave portions 51*a* of the lower front wheel chassis 51 slidably. That is, the end portions 61*a* of the arms 61, 61 are nipped by the upper front wheel chassis 52 and the lower front wheel chassis 51 with the upper front wheel chassis 52 and the end portions 61*a*, and the lower front wheel chassis 51 and the end portions 61*a*, slidable on each other, respectively. Consequently, the front wheel chassis 5 and the rear wheel chassis 6 can relatively rock smoothly in the horizontal direction and the vertical direction while preventing the dropping-off of the end portions 61*a* of the arms 61, 61 from the front wheel chassis 5, and enlarging the twist angle between the front wheel chassis 5 and the rear wheel chassis 6.

Furthermore, because each of the two arms 61, 61 is made of a twistable elastic member, the twist angle between the front wheel chassis 5 and the rear wheel chassis 6 can further be enlarged by the twisting of the arms 61, 61.

Furthermore, because each of the two arms 61, 61 is formed in a flat plate, inclining toward the inside of the automobile toy 1 in the vehicle width direction, even if an external force parallel to the vehicle width direction is applied, the external force can be dispersed according to the inclination angle. That is, the load into the vehicle width direction, in which it is hard to cause elastic deformation, can be reduced, in comparison with the case of horizontally providing the arms, shaped in flat plates. Accordingly, deformation and breakage of the arms 61, 61 can be suppressed.

In addition, the present invention should not be interpreted to be limited to the aforesaid embodiment, but it should be understood that suitable changes and improvements can be performed.

For example, although the two arms 61, 61 are designed to be mounted on the rear wheel chassis 6 in the embodiment described above, the arms 61, 61 may be configured otherwise, as long as the arms 61, 61 couple the front wheel chassis 5 and the rear wheel chassis 6 to each other with each of the arms 61, 61 separated from each other in the vehicle width direction. The two arms 61, 61 may be provided on the front wheel chassis 5, or may be the members independent of both the chassis 5 and 6.

Furthermore, the configurations of the hemispherical projecting portions and concave portions to be formed at the respective end portions 61*a* of the two arms 61, 61 and the respective coupling portions 55 of the front wheel chassis 5 are not limited to those of the aforesaid embodiment. That is, the respective end portions 61*a* of the two arms 61, 61 and the respective coupling portions 55 of the front wheel chassis 5 may be configured otherwise, as long as the end portions 61*a* and the coupling portions 55 have hemispherical sliding surfaces that have central axes in the vertical direction and are mutually complementary, with the sliding surfaces slidable on each other, by which the end portions 61*a* and the coupling portions 55 are coupled to each other. The front wheel chassis 5 and the rear wheel chassis 6 can, hereby, relatively rock into the horizontal direction and the vertical direction smoothly.

Figure 8:
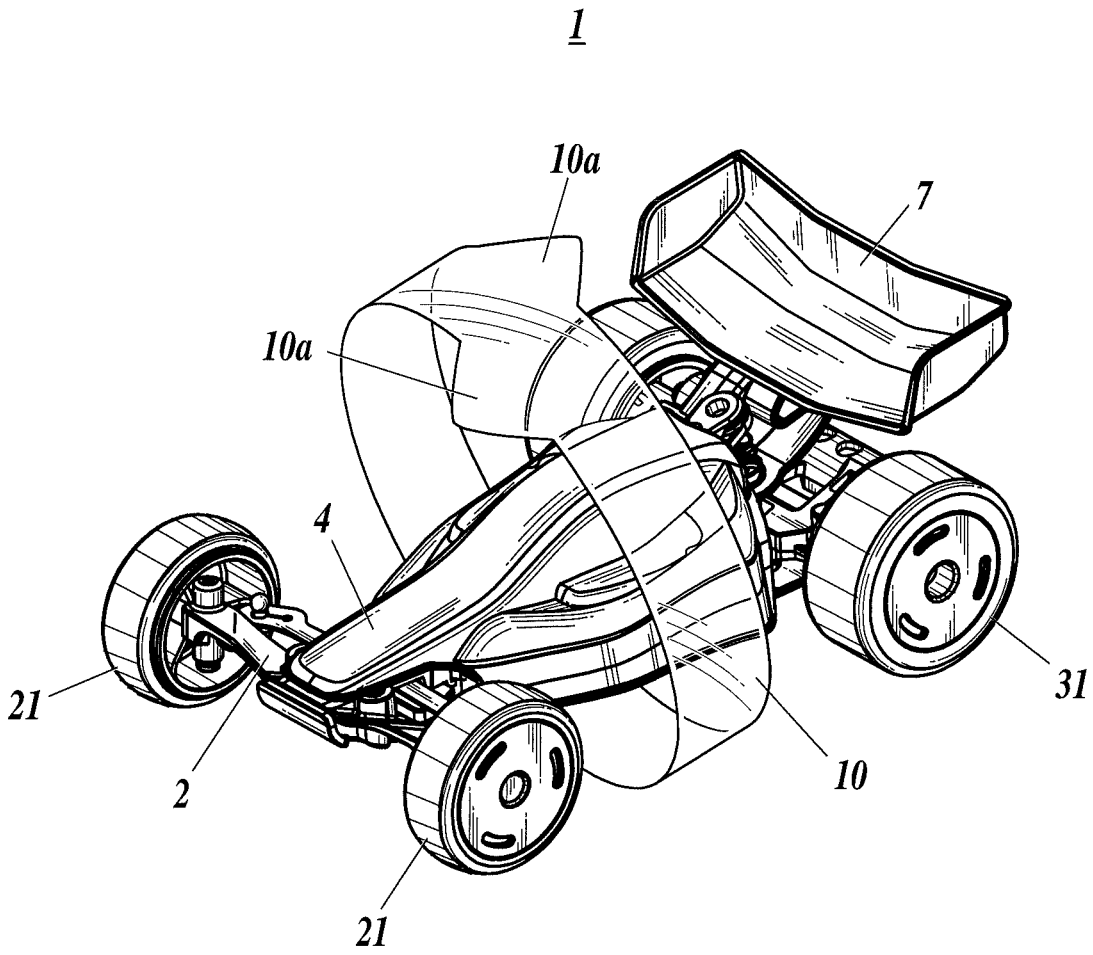
FIG. 8 is an a perspective view of an automobile toy provided with an overturn prevention ring.

Furthermore, as shown in FIG. 8, it is preferable to provide an overturn prevention ring 10, shaped in almost a belt, on the automobile toy 1. The overturn prevention ring 10 is made of a transparent polycarbonate and is fixed to the back surface of the lower front wheel chassis 51 to enclose the automobile toy 1 at almost the central part in the front and rear direction. Furthermore, two projections 10*a*, 10*a* are formed at the top end of the overturn prevention ring 10 projecting into the front and rear direction. The positions of the two projections 10*a*, 10*a* in the circumferential direction are different from each other, with the center of the vehicle width direction between the two projections 10*a*, 10*a*. By providing such an overturn prevention ring 10, the automobile toy 1 can be protected, and further if the automobile toy 1 is likely to overturn, the overturn prevention ring 10 touches a wall or a road surface to make it possible that the automobile toy 1 restores its posture. Furthermore, even if the automobile toy 1 has been inverted, the projections 10*a*, 10*a* make the inversion state unstable, because the automobile toy 1 is supported by a pointed end of one of the projections 10*a*, 10*a*. Therefore, the posture of the automobile toy 1 can be restored by causing a reaction by steering the front wheels 21, 21 or driving the rear wheels 31, 31.

The entire disclosure of Japanese Patent Application No. 2010-006628 filed on Jan. 15, 2010 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An automobile toy, comprising:

a front wheel chassis for supporting a front wheel axle; and a rear wheel chassis for supporting a rear wheel axle and including two arms extending forward along sides of the front wheel chassis, front end portion of each of the two arms being coupled to the sides of the front wheel chassis with the two arms separated from each other in a width direction of the automobile toy with a rear end portion of the front wheel chassis being located in the separation but spaced from the two arms, wherein each of the two arms is made of an elastic member and functions as a suspension, wherein the front wheel chassis includes an upper front wheel chassis and a lower front wheel chassis which together press against the front end portion of each of the two arms therebetween from above and below, respectively, and wherein the suspension allows the rear wheel chassis to move relative to the front wheel chassis.

2. The automobile toy according to claim 1, wherein each of the two arms is twistable.

3. The automobile toy according to claim 1, wherein each side of the upper front wheel chassis includes a coupling portion at which the front end portion of each of the two arms is coupled thereto, each front end portion has hemispherical first sliding surfaces, and the coupling portion has hemispherical second sliding surfaces, the first sliding surfaces and the second sliding surfaces being mutually complementary and having central axes in a vertical direction, and the front end portion and the coupling portion are coupled to each other with the first sliding surfaces and the second sliding surfaces slidable on each other.

4. The automobile toy according to claim 1, wherein the upper front wheel chassis includes two sides and each side includes a hemispherical first projecting portion projecting downward, each front end portion includes a hemispherical first concave portion that is complementary to the first projecting portion and opens upward, and a hemispherical second projecting portion projecting downward, the first concave portion and the second projecting portion being mutually concentric, the lower front wheel chassis includes two sides corresponding to the two sides of the upper front wheel chassis and each side of the lower front wheel chassis includes a hemispherical second concave portion that is complementary to the second projecting portion and opens upward, and each front end portion is coupled to each side of the upper and lower front wheel chassis, with the first concave portion slidably receiving the first projecting portion and with the second projecting portion slidably receiving the second concave portion.

5. The automobile toy according to claim 1, wherein each of the two arms has a rectangular-shaped cross section inclining toward an inner part of the automobile toy in the automobile toy width direction, the cross section being orthogonal to a direction in which the arms extend.

* * * * *